US012215468B2

(12) United States Patent
Brodowski

(10) Patent No.: US 12,215,468 B2
(45) Date of Patent: Feb. 4, 2025

(54) TRANSPARENT OR TRANSLUCENT PANEL SYSTEMS, RELATED SYSTEMS, AND RELATED METHODS

(71) Applicant: CONTECH ENGINEERED SOLUTIONS LLC, West Chester, OH (US)

(72) Inventor: David M. Brodowski, Oakwood, OH (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 0 days.

(21) Appl. No.: 17/236,109

(22) Filed: Apr. 21, 2021

(65) Prior Publication Data

US 2021/0332538 A1 Oct. 28, 2021

Related U.S. Application Data

(60) Provisional application No. 63/013,623, filed on Apr. 22, 2020.

(51) Int. Cl.
*E01D 19/00* (2006.01)

(52) U.S. Cl.
CPC ..... *E01D 19/00* (2013.01)

(58) Field of Classification Search
CPC ..... E01D 19/00
USPC ..... 14/77.1, 78
See application file for complete search history.

(56) References Cited

U.S. PATENT DOCUMENTS

| | | | | | |
|---|---|---|---|---|---|
| 4,620,612 | A * | 11/1986 | Enoki | E04G 3/30 | 182/113 |
| 5,299,655 | A * | 4/1994 | Margaritis | E04G 3/22 | 182/138 |
| 5,957,239 | A * | 9/1999 | Marshak | E01D 19/106 | 411/401 |
| D512,513 | S * | 12/2005 | Wasniak | D25/1 | |
| 8,739,496 | B2 * | 6/2014 | Brodowski | E04B 5/38 | 52/794.1 |
| 9,574,318 | B2 * | 2/2017 | Brodowski | B05D 1/02 | |
| 10,280,635 | B1 * | 5/2019 | Apostolopoulos | F03D 80/50 | |
| 10,801,198 | B2 * | 10/2020 | Brodowski | E04B 1/2403 | |
| 11,072,933 | B2 * | 7/2021 | Brodowski | E04G 11/08 | |
| 11,339,563 | B2 * | 5/2022 | Brodowski | E01D 19/125 | |
| 2005/0265780 | A1 * | 12/2005 | Humphries | E01F 8/0017 | 404/6 |
| 2008/0250579 | A1 * | 10/2008 | Sten | E01D 19/106 | 14/73 |
| 2019/0169816 | A1 * | 6/2019 | Desai | E02F 3/401 | |

OTHER PUBLICATIONS

Michigan Department of Transportation, "Special Provision For Metal Mesh Panels" (4 pages).
Michigan Department of Transportation, "Wood False Decking" (2 pages).

* cited by examiner

*Primary Examiner* — Raymond W Addie
(74) *Attorney, Agent, or Firm* — Bookoff McAndrews, PLLC

(57) ABSTRACT

A system includes one or more panels that are configured to span a frame of bridge beams and be positioned below an existing bridge deck. The one or more panels are transparent or translucent and are configured to catch material that separates from the bridge deck.

20 Claims, 2 Drawing Sheets

TRANSPARENT OR TRANSLUCENT PANEL SYSTEMS, RELATED SYSTEMS, AND RELATED METHODS

CROSS-REFERENCE TO RELATED APPLICATIONS

This patent application claims the benefit of priority under 35 U.S.C. § 119 to U.S. Provisional Patent Application No. 63/013,623, filed on Apr. 22, 2020, which is herein incorporated by reference in its entirety.

TECHNICAL FIELD

Aspects of the present disclosure generally relate to construction systems and procedures. Particular aspects relate to transparent or translucent panel systems for bridge decks, related systems, and related methods.

BACKGROUND

With nearly 40% of America's bridges older than 50 years, and the average bridge age of 43 years old, many of the country's bridge components have reached their useful life and need to be rehabilitated or replaced. The bridge riding surface, or bridge deck, is typically the most likely to deteriorate with age and exposure to heavy loads, large volumes of traffic, weather, deicing salts, etc. Even with maintenance and repairs, bridge decks typically need to be replaced within 30 to 50 years due to excessive cracking, spalling, delamination, and/or efflorescence, which can reduce the load carrying capacity of the deck and be a risk to the public. While bridge owners are aware of these risks, they often lack the funding and/or resources to address the deficiencies quickly, and it can take years before repairs or replacements can be programmed and executed.

For bridge decks in poor condition, bridge owners often look to protect motorists and pedestrians from potential hazards resulting from deck deterioration and the potential for the material to separate from the deck. One method often used to address this issue is to install a false deck, or protective shield beneath the existing concrete deck to catch debris and prevent it from falling and injuring people or property. The false deck is usually constructed from lumber and plywood if the bridge deck is programmed for replacement or rehabilitation within about 4 years. If the bridge deck is programmed for replacement for later than 4 years, then metal mesh panels are often used. One reason mesh panels are often used over lumber is the ability to see through the mesh to the underside of the concrete deck and see whether portions of the deck have fallen and collected on the metal mesh. Bridge inspectors need to continue to monitor the condition of the bridge over time and take action if the deterioration of the bridge becomes severe. Additionally, metal mesh panels may deteriorate at a slower rate than lumber to form the false deck, and deterioration may pose safety risks to inspectors walking on the false deck and/or to people or property below the false deck. While the metal mesh is beneficial for visibility, metal mesh is often ineffective in preventing deteriorated concrete and/or steel from falling below, for example, through openings in the metal mesh.

One or more aspects of this disclosure may help to provide for a false deck, or protective shield, that offers the ability to inspect the underside of the bridge deck for deficiencies while protecting people and property from hazards resulting from deck deterioration and/or material separating from the bridge deck. Aspects of the present disclosure include a transparent or translucent panel for existing bridges and floor slabs that allows for some, for example, the majority, of the concrete surface to be visible through the panel and, at the same time, retain separated material that has fallen to prevent the material from falling on people, vehicles, property, etc. below. The transparent or translucent panel may offer many of the benefits of traditional false decking but with added abilities to both inspect and protect from hazards.

The transparent or translucent panel system discussed herein may allow for inspection of the underside of the bridge deck for deficiencies, while also protecting people and property from hazards resulting from deck deterioration and/or material separating from the bridge deck.

SUMMARY

Aspects of the present disclosure relate to, among other things, apparatuses, and methods that include plywood, lumber, or metal mesh panels used for false decks with transparency or translucency to allow for inspection and protection of people, vehicles, property, etc. below the bridge. The visibility also helps to allow for inspectors to not only see the bridge deck concrete condition, but also to see if concrete has separated and collected on the false deck. Aspects of the disclosure may help to significantly reduce the bridge owners' risk exposure as aspects of the disclosure help to allow the bridge owners to monitor the condition of the bridge from below and protect the public under the bridge from falling concrete or other deteriorated materials. By seeing the condition of the deck, owners can take action to make necessary repairs to prevent localized failures of the deck, further reducing risk to the public travelling on the bridge itself. If hazards are identified and addressed quickly, the potential for failure of the bridge deck can be reduced.

The material for the transparent or translucent false decking may include, for example, a variety of commercially available materials, such as glass polymer composites, polycarbonate, fiber reinforced polymer, fiberglass, and poly (methyl methacrylate) also known as Plexiglass, Lucite, and Perspex. Sheets of transparent or translucent material may be placed from flange to flange of adjacent bridge beams (longitudinal direction), supported transversely by angles or plates attached to the top or bottom flanges of steel or concrete bridge beams. The bridge beams may be parallel, or they may extend at angles relative to each other. The angle or plate support system can be customized to each project, for example, depending on the owner's requirements for attaching the angle or plate support system to the existing bridge. Additional support, if needed, beneath the transparent or translucent sheets in the transverse or longitudinal direction could include steel or composite material joists, bars, or tubes. Alternatively or additionally, the additional support may include fabric straps. The transverse distance between the supports is the span of the false deck. The false deck panels are positioned or assembled in longitudinally adjacent relation parallel to spaced steel or concrete beams. The sheets of transparent or translucent material may be flat, corrugated, or placed in multiple layers or thicknesses to provide the stiffness needed to support the impact load from falling concrete, construction loading, and any additional loading required by the bridge owner. Modifiers could be added to the sheets of transparent or translucent material to improve durability, impact resistance, UV resistance, or other features or characteristics, for example, as required by the bridge owner.

In one aspect, a system may include one or more panels that may be configured to span a frame of bridge beams and may be positioned below an existing bridge deck. The one or more panels may be transparent or translucent and may be configured to catch material that separates from the bridge deck.

The system may include one or more of the following aspects. The one or more panels may include a plurality of transparent or translucent sheets. The one or more panels may be placed in multiple layers. The plurality of transparent or translucent sheets may be flat or corrugated. The transparent or translucent sheets may contain one or more of a rubber modifier for improved impact resistance and/or UV resistant modifier for improved resistance to effects of ultraviolet light on the transparent or translucent sheets. The one or more panels may be configured to be positioned near the top flange of the existing bridge girders. The system may further include at least one angle attached to a flange of the bridge beams. The one or more panels may be supported by the at least one angle, and the one or more angles may be attached to the bridge beams with a mechanical or adhesive anchor. The one or more panels may be formed of one or more of glass polymer composites, polycarbonate, fiber reinforced polymer, fiberglass, and poly (methyl methacrylate).

The system may further include one or more additional supports positioned beneath the one or more panels. The one or more additional supports may include one or more of joists, bars, or tubes, and the joists, bars, or tubes may be formed of steel or a composite material. The one or more additional supports may include fabric straps. The one or more panels may be suspended from the bridge deck. Each of the one or more panels may include a weight of approximately 65 pounds.

In another aspect, a transparent or translucent panel for a bridge may include one or more layers of a transparent or translucent material. The transparent or translucent panel may be configured to be positioned below an existing bridge deck and prevent material from the bridge deck falling below the transparent or translucent panel.

The transparent or translucent panel may include one or more of the following aspects. The one or more layers may be formed of one or more of glass polymer composites, polycarbonate, fiber reinforced polymer, fiberglass, and poly (methyl methacrylate). The transparent or translucent panel may be formed of plurality of transparent or translucent sheets. The plurality of transparent or translucent sheets may be flat or corrugated, and the plurality of transparent or translucent sheets contain a rubber modifier or an ultraviolet light modifier.

In yet another aspect, a transparent or translucent panel system may include one or more transparent or translucent panels, a plurality of angles, and a plurality of anchors. Each angle may be configured to couple the one or more transparent or translucent panels to bridge beams. Each anchor may be configured to couple one of the plurality of anchors to one of the bridge beams.

The transparent or translucent panel system may include one or more of the following aspects. Each of the plurality of angles may be L-shaped and is formed of a steel. The anchors may be mechanical or adhesive anchors. Each of the plurality of sheets may be formed of one or more of glass polymer composites, polycarbonate, fiber reinforced polymer, fiberglass, and poly (methyl methacrylate). The transparent or translucent panel system may further include one or more additional supports configured to be positioned below the transparent or translucent panel. The one or more additional supports may include one or more of joists, bars, tubes, or fabric straps.

As used herein, the terms "comprises," "comprising," "includes," "including," or any other variation thereof, are intended to cover a non-exclusive inclusion, such that a process, method, article, or apparatus that comprises a list of elements does not include only those elements, but may include other elements not expressly listed or inherent to such process, method, article, or apparatus. Unless stated otherwise, the term "exemplary" is used in the sense of "example," rather than "ideal." The terms "approximately" and "about" refer to being nearly the same as a referenced number or value. As used herein, the terms "approximately" and "about" generally should be understood to encompass ±10% of a specified amount or value.

It may be understood that both the foregoing general description and the following detailed description are exemplary and explanatory only and are not restrictive of the disclosure, as claimed.

Other features and advantages of the disclosure will be apparent from the following description and drawings.

BRIEF DESCRIPTION OF THE DRAWINGS

The accompanying drawings, which are incorporated herein, and constitute a part of this specification, illustrate exemplary aspects of the present disclosure and together with the description, serve to explain the principles of the disclosure.

DETAILED DESCRIPTION

The present disclosure is now described with reference to exemplary aspects of structure and construction methods for transparent or translucent panel systems for bridge decks, for example, existing bridge decks. Some embodiments are depicted and/or described with reference to the structure and mounting methods of a transparent or translucent panel below a portion of a bridge deck, for example, to form a transparent or translucent false decking.

Reference will now be made in detail to examples of the present disclosure described above and illustrated in the accompanying drawings. Wherever possible, the same reference numbers will be used throughout the drawings to refer to the same or like parts.

Figure 1:
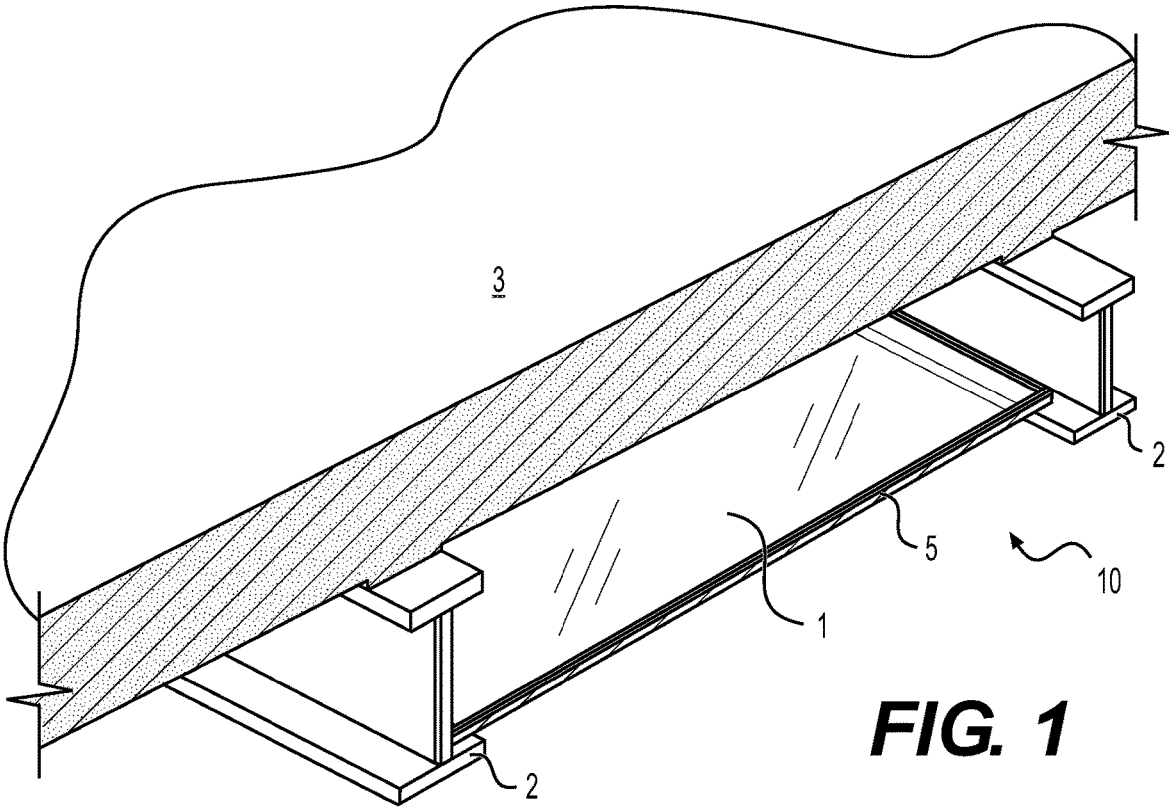
FIG. 1 illustrates a perspective view of a transparent or translucent panel system, according to aspects of the present disclosure.
Figure 2:
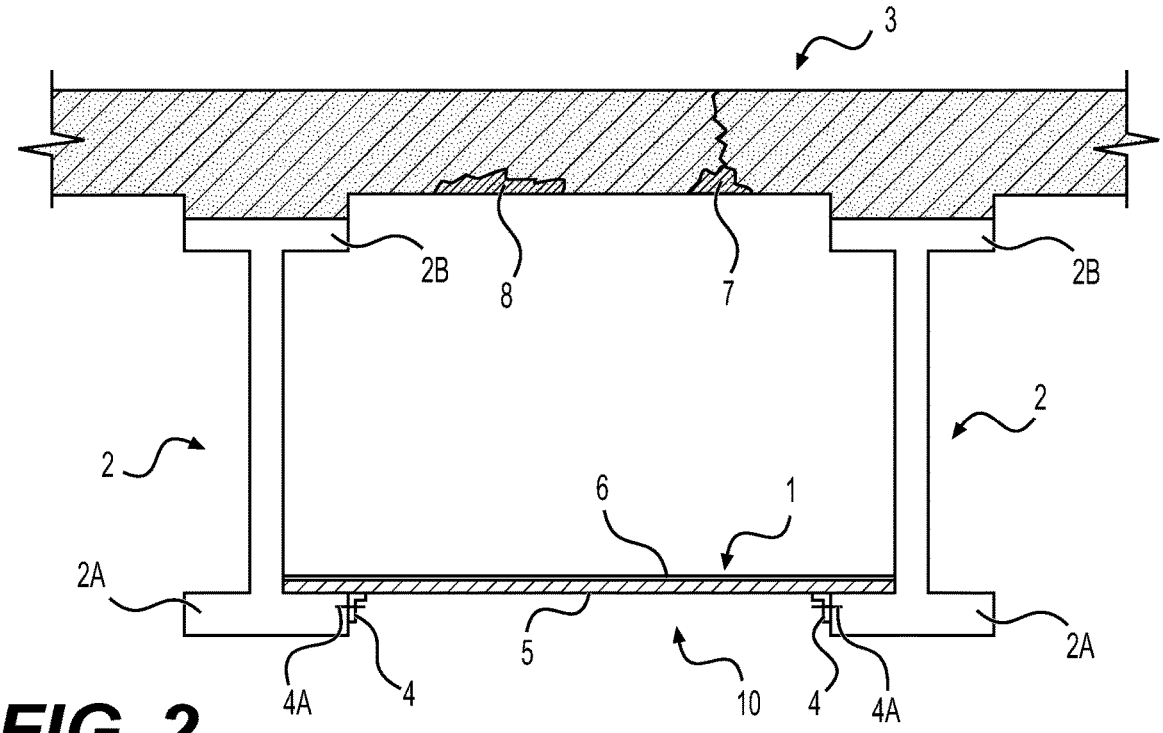
FIG. 2 is a cross-sectional view of a bridge with the transparent or translucent panel in a first position, according to aspects of the present disclosure.
Figure 3:
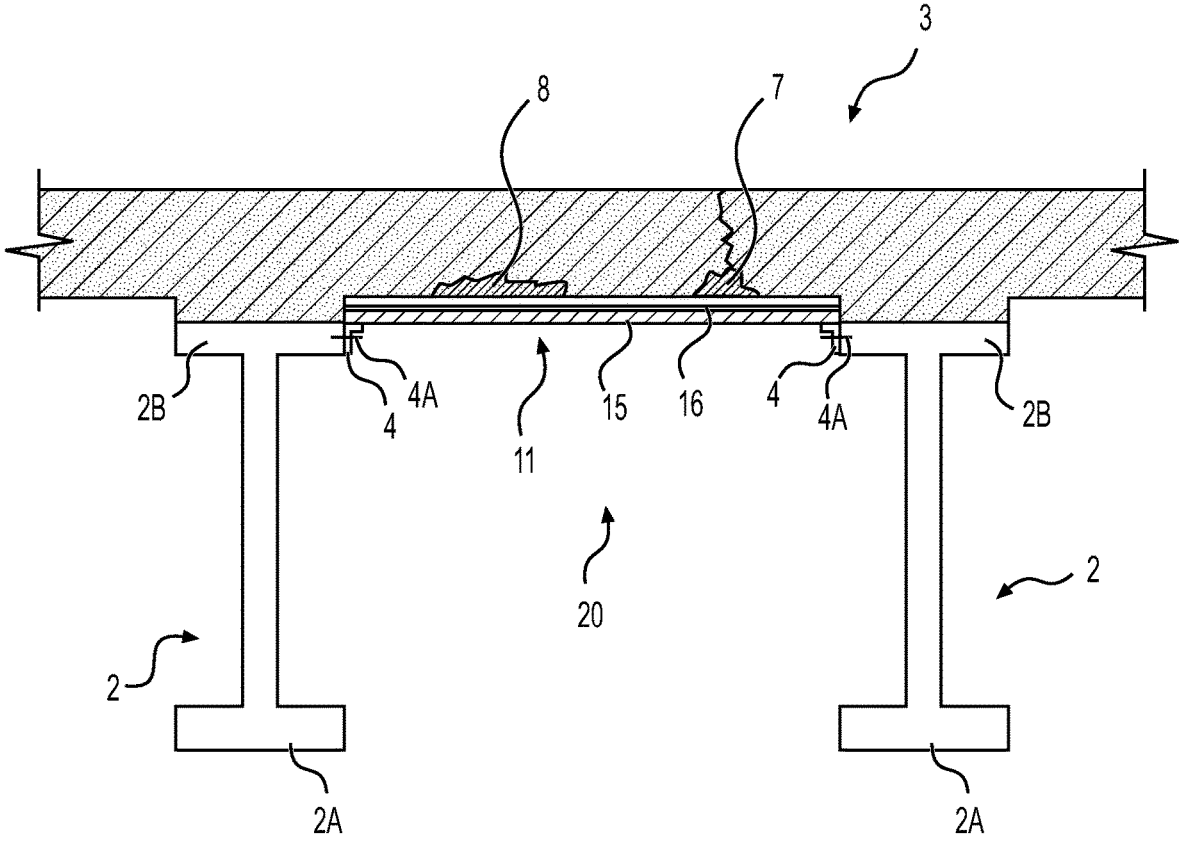
FIG. 3 is a cross-sectional view of a bridge with a transparent or translucent panel in a second position, according to aspects of the present disclosure.

Exemplary aspects of the present disclosure are illustrated in FIGS. 1-3 attached hereto. Referring now to the figures individually, FIG. 1 illustrates a perspective view of a transparent or translucent panel system. FIG. 2 is a cross-sectional view of a bridge with a transparent or translucent panel in a first position, and FIG. 3 is a cross-sectional view of a bridge with a transparent or translucent panel in a second position.

FIG. 1 illustrates a transparent or translucent panel system 10 that includes a transparent or translucent panel 1. The transparent or translucent panel system 10 may be coupled to and span a frame of parallel spaced bridge girders or bridge beams 2 seated on the bottom flange of the beams to protect people and property from hazards resulting from the deterioration of an existing bridge deck 3. The transparent or translucent panel 1 may allow for at least a portion (e.g., the majority) of the deck 3 to be viewed from below, for example, for inspection purposes. Additionally, if deteriorated material separates from the bridge deck 3, the transparent or translucent panel 1 may catch the material, preventing the material from falling below the bridge beams 2. The material may collect on the transparent or translucent panel 1, and the material may then be seen from below, indicating the location of deterioration on the bridge deck 3. The panel system 10 may include a plurality of transparent or translucent sheets, which may be flat or corrugated, with enough stiffness and impact resistance to support construction loads, wind loads, and falling material from the bridge deck 3. Additionally or alternatively, one or more reinforcements 5 may be positioned below one or more portions of the transparent or translucent panel 1, for example, extending between adjacent bridge beams 2.

FIG. 2 is a cross-sectional view of a bridge with the bridge deck 3 supported by bridge beams 2. Additionally, FIG. 2 illustrates the transparent or translucent panel system 10 with the transparent or translucent panel 1 positioned on the bridge beams 2 below the bridge deck 3. For example, the bridge beams 2 may each be I-beams, each having a bottom portion or flange 2A and a top portion or flange 2B. The transparent or translucent panel 1 may be mounted to respective portions of bottom flanges 2A on adjacent bridge beams 2. For example, as shown in FIG. 2, edge portions of transparent or translucent panel 1 may at least partially overlap with bottom flanges 2A. Alternatively, although not shown, transparent or translucent panel 1 may be mounted to bottom flanges 2A and not overlap with portions of bottom flanges 2A. In one or more of these aspects, the transparent or translucent panel 1 may be supported by one or more reinforcements 5. In this aspect, a portion 6 of the transparent or translucent panel 1 may be positioned above the reinforcement 5. Portion 6 may be formed of one or more transparent or translucent sheets.

As shown in FIG. 2, the transparent or translucent panel 1 may be flat and may be supported by an angle 4. The angle 4 may be attached to a portion of a bottom flange 2A of the beam 2, for example, with a mechanical or adhesive anchor 4A. In at least one aspect, anchor 4A may extend through a portion of the angle 4 and into a portion of the bottom flange 2A. It is noted, however, that if the transparent or translucent panel 1 overlaps with portions of bottom flanges 2A, then the angles 4 may not be necessary to support the transparent or translucent panel 1. Nevertheless, the angles 4 may still be used to help support or otherwise couple the transparent or translucent panel 1 to the bridge beams 2.

One or more screws, bolts, or other coupling mechanisms may be used to help couple the transparent or translucent panel 1 to the bridge beams 2, for example, via one or more angles 4. For example, at least one screw, bolt, or other coupling mechanism may be coupled to each side (e.g., longitudinally, or the left and right sides, as shown in FIGS. 1-3) of the transparent or translucent panel 1. The at least one screw, bolt, etc. may be positioned vertically and delivered vertically through (e.g., through an opening) in the horizontal leg of the angle 4, and into at least a portion of the transparent or translucent panel 1. In this aspect, the at least one screw, bolt, etc. may be positioned from below the transparent or translucent panel 1. Alternatively, the at least one screw, bolt, etc. may be delivered through (e.g., an opening) in the transparent or translucent panel 1 and also through the horizontal leg of the angel 4. In this aspect, the at least one screw, bolt, etc. may be positioned from above the transparent or translucent panel 1. Alternatively or additionally, one or more adhesives (structural VHB tape, epoxy, adhesive caulk, etc.) may be used to help couple the transparent or translucent panel 1 to the bridge beams 2. For example, the one or more adhesives may be used to couple the transparent or translucent panel 1 to the angles 4. In these aspects, the angles 4 and the screws, bolts, coupling mechanisms and/or adhesives may help to retain the transparent or translucent panel 1, for example, helping to prevent wind (e.g., uplifts), lateral loads, or other forces on the transparent or translucent panel 1 from separating the transparent or translucent panel 1 from the angles 4, and thus also from the bridge beams 2.

FIG. 3 is a cross-sectional view of a bridge with the bridge deck 3 supported by the bridge beams 2, and including a transparent or translucent panel system 20. Additionally, FIG. 3 illustrates a transparent or translucent panel system 20 with a transparent or translucent panel 11 positioned on the bridge beams 2 below the bridge deck 3. For example, as discussed above, the bridge beams 2 may each be !-beams with the bottom flange 2A and the top flange 2B. As shown in FIG. 3, the transparent or translucent panel 11 may be mounted to respective portions of the top flanges 2B on adjacent bridge beams 2. For example, as shown in FIG. 3, edge portions of the transparent or translucent panel 11 may be mounted on and at least partially abut against top flanges 2B. Alternatively, although not shown, transparent or translucent panel 11 may at least partially overlap with the top flanges 2B, for example, if there is an opening or spacing between a portion of the top flanges 2B and the bridge deck 3. In one or more of these aspects, the transparent or translucent panel 11 may be supported by one or more reinforcements 15. In this aspect, a portion 16 of the transparent or translucent panel 11 may be positioned above the reinforcement 15.

As shown in FIG. 3, the transparent or translucent panel 11 may be flat and may be supported by one or more angles 4. The angle 4 may be attached to a portion of top flange 2B of the beam 2, for example, with a mechanical or adhesive anchor 4A. In at least one aspect, the anchor 4A may extend through a portion of angle 4 and into a portion of top flange 2B. For example, the angle 4 may be formed of steel (e.g., galvanized steel). The angle 4 may be L-shaped, and may include a height of approximately two inches and a width of approximately two inches. The angle 4 may include a length of approximately eight feet. Furthermore, three anchors 4A may be positioned along a length of each of the angles 4 to couple the angles 4 to the bridge beams 2. The anchors 4A may be anchor bolts, for example, expansion or epoxy type anchor bolts.

In one aspect, the bridge beams 2 may each include bottom flanges 2A and top flanges 2B with cross-sectional widths of, for example, between approximately ten inches and approximately four feet and one inch, for example, approximately two feet and six inches. The bridge beams 2 may be spaced any distance away, and bridge beams 2 of a single bridge may have variable spacings. For example, the centers of the bridge beams may be spaced away by, for example, between approximately four feet and approximately ten feet. In one example, the bridge beams 2 may be spaced apart by approximately six feet and five inches. Accordingly, edges of the bottom flanges 2A and the top flanges 2B may be spaced apart by approximately four feet, for example, approximately three feet and eleven inches. In this aspect, the transparent or translucent panels 1, 11 may be approximately the same or slightly less than the distance between the bottom flanges 2A or the top flanges 2B of the bridge beams 2. For example, the transparent or translucent panels 1, 11 may include a width of approximately three feet and nine inches. In this aspect, there may be a small gap (e.g., approximately 1-2 inches, for example, approximately 1.5 inches) between the edges of the transparent or translucent panel 1 and the bridge beams. The angles 4 may span the gap(s) between the transparent or translucent panels 1, 11 and the bridge beams 2. Additionally, the translucent or transparent panels 1, 11 may include a length (e.g., into the page of FIG. 2) of between approximately two feet to eight feet, for example, approximately four feet. The sizes of the transparent or translucent panels 1, 11 may be consistent with standard sizes of the materials (e.g., acrylics or polycarbonates) and/or depend on the sizes, shapes, spacings, etc. of the flanges 2A and 2B. Furthermore, the sizes of the transparent or translucent panels 1, 11 may allow for efficient fabrication, shipping (e.g., via freight), assembly, etc.

Alternatively, as discussed with respect to FIG. 2, the transparent or translucent panel 1 may at least partially rest on a portion of the bridge beams 2, for example, on top portions of the bottom flanges 2A. Alternatively, as discussed with respect to FIG. 2, the translucent or transparent panel 1 may include a width that is greater than the distance between the flanges of the bridge beams 2. For example, the bottom flanges 2A of the bridge beams 2 may be spaced apart by approximately four feet, and the transparent or translucent panel 1 may include a width that is greater than four feet, for example, approximately five feet, 5.5 feet, six feet, etc. In these aspects, the transparent or translucent panel 1 may overlap with portions of the bottom flanges 2A of the bridge beams 2. For example, the transparent or translucent panel 1 may be between approximately three inches and approximately six inches longer than the spacing between edges of the bottom flanges 2A of the bridge beams 2. In this example, the transparent or translucent panel 1 may overlap with the bottom flanges 2A of the bridge beams 2 by between approximately 1.5 inches and approximately 3 inches, forming bearing lengths on both sides of the transparent or translucent panel 1, which may help to support or couple the transparent or translucent panel 1, while also preventing material from the bridge deck from falling below the transparent or translucent panel 1. Additionally, the translucent or transparent panels 1 may include a length (e.g., into the page of FIG. 2) of between approximately two feet and approximately eight feet, for example, approximately four feet.

Furthermore, in any of the aspects discussed herein, the transparent or translucent panels 1, 11 include a height. The height of the transparent or translucent panels 1, 11 may vary depend on the desired loading requirements, length of the transparent or translucent panels 1, 11, etc. In some aspects, the transparent or translucent panels 1, 11 may include a height between approximately 0.5 inches and approximately 8 inches, for example, between approximately 1.5 inches and approximately 6 inches, for example, approximately 2.5 inches.

In any of these aspects, the transparent or translucent panels 1, 11 may include a weight of approximately 80 pounds or less, for example, approximately 65 pounds, such that contractors or other professionals, for example, two contractors, may lift and maneuver each of the transparent or translucent panels 1, 11.

Although not shown, the transparent or translucent panels 1, 11 may be suspended (e.g., hang from) from the existing bridge deck, rather than being mounted on or otherwise supported by the bridge beams 2. For example, the transparent or translucent panels 1, 11 may be clamped to the existing girders (e.g., steel girders) for support and be positioned below the bridge deck.

The components and/or materials of the transparent or translucent panels 1, 11 may be configured to support the loading from construction activities, wind, and impact from falling material. In some aspects, the transparent or translucent panels 1, 11 may include a plurality of transparent or translucent sheets. For example, the plurality of transparent or translucent sheets (e.g., thinner sheets of the transparent or translucent material) may be stacked vertically to form multiple layers of transparent or translucent material in a position below the bridge deck 3. In one example, the transparent or translucent sheets may be flat. In another example, the transparent or translucent sheets may be corrugated. In any of these examples, the transparent or translucent sheets may include a rubber modifier, for example, for improved impact resistance. In this aspect, the rubber modifier may be added to the material (e.g., a mixture of acrylic plastic pellets) in various percentages or ratios during the process of making the transparent or translucent sheets. In another aspect, the material used to form the transparent or translucent sheets may be naturally or inherently impact resistant, for example, when the transparent or translucent sheets are formed of a polycarbonate.

In some aspects, the material used to form the transparent or translucent sheets may change color (e.g., darken, yellow, etc.) over time and/or when exposed to ultraviolet ("UV") light, for example, when the transparent or translucent sheets are formed of a polycarbonate. In this aspect, a UV modifier may be added to the material (e.g., a mixture of polycarbonate pellets) in various percentages or ratios during the process of making the transparent or translucent sheets. The UV modifier may help to prevent, reduce, counteract, or otherwise negate the effect(s) of UV light on the transparent or translucent sheets. In other aspects, the material used to form the transparent or translucent sheets may be naturally or inherently resistant to UV light, for example, when the transparent or translucent sheets are formed of an acrylic. Furthermore, in any of the aspects discussed herein, the transparent or translucent sheets may be formed in accordance with one or more specifications, for example, an ASTM specification (e.g., ASTM D4802).

As mentioned above, as shown in FIGS. 1-3, it may be desired to provide one or more discrete supports or reinforcements 5, 15 beneath one or more portions of the transparent or translucent panels 1, 11, for example, when the transparent or translucent panels 1, 11 span longer distances or may withstand or otherwise be exposed to heavier loads. The one or more supports or reinforcements 5, 15 may include, for example, one or more of joists, bars, or tubes, and wherein the joists, bars, or tubes that are formed of steel or composite material. Alternatively or additionally, the one or more supports or reinforcements 5, 15 may include fabric straps. In this aspect, the portions 6, 16 of the transparent or translucent panel 1 may be positioned above the reinforcements 5, 15 as shown in FIGS. 2 and 3.

Furthermore, as shown in FIGS. 2 and 3, one or more cracks 7 or damaged portions 8 may formed in the bridge deck 3, for example, in a bottom portion of the bridge deck 3. The one or more cracks 7 or damaged portions 8 may be visible from below the bridge deck 3 through the transparent or translucent panels 1, 11. Additionally, any material that breaks off from the bridge deck 3 in the formation of the one or more cracks 7 or damaged portions 8 may collect on the transparent or translucent panels 1, 11. In this aspect, preventing the material from falling to the ground may help to prevent injuries to people traveling under the bridge deck 3, damage to the ground below the bridge deck 3, etc. The collection of the material from the bridge deck 3 may also indicate to an inspector that one or more cracks 7 or damaged portions 8 have developed in the bridge deck 3. Unlike a fencing, wiring, grate, or other shielding material that includes openings that may be positioned below a bridge deck, the transparent or translucent panels 1, 11 do not allow smaller pieces of material to pass through openings.

As discussed herein, the transparent or translucent panels 1, 11 may be formed of one or more materials that is at least partially transparent or translucent, for example, allowing a substantial or majority of light to pass through the material. In this aspect, an inspector may view one or more portions of the bridge deck 3 through the transparent or translucent panels 1, 11. The transparent or translucent panels 1, 11 may be formed of, for example, one or more of, for example, a variety of commercially available materials, such as glass polymer composites, polycarbonate, fiber reinforced polymer, fiberglass, and poly (methyl methacrylate) also known as Plexiglass, Lucite, and Perspex.

The transparent or translucent panels 1, 11 and the mounting systems 10, 20 discussed herein may be positioned below existing bridge decks 3 and coupled to existing bridge beams 2. The transparent or translucent panels 1, 11 do not have openings, so material (even smaller pieces of material) does not pass through the transparent or translucent panels 1, 11. When the transparent or translucent panel 1 are positioned on or near the lower or bottom flange 2A, as shown in FIG. 2, the transparent or translucent panel 1 may be used as a working platform, for example, supporting inspection and/or maintenance crews as they inspect, maintain, repair, replace, or otherwise treat the bridge deck 3.

The transparent or translucent panels 1, 11, when assembled, may have a weight that is approximately 10 pounds per square foot or less, for example, approximately, six pounds per square foot or less. The additional weight from the transparent or translucent panels 1, 11 when coupled to the bridge beams 2 or to the bridge deck 3 may be less than panels formed of lumber, fencing materials, etc., which may help to improve the load carrying capacity of the bridge beams 2 and/or of the bridge deck 3. Furthermore, in some aspects, the transparent or translucent panels 1, 11 may be fairly lightweight, for example, approximately 80 pounds or less, or approximately 65 pounds. In these aspects, two people may handle (e.g., lift, manipulate, etc.) the transparent or translucent panels 1, 11, for example, without the need for additional lifting equipment (e.g., a crane).

Furthermore, the transparent or translucent panels 1, 11 and the mounting systems 10, 20 discussed herein may be removed and relocated to a different location (e.g., below a different bridge) once the bridge deck 3 is repaired, replaced, sufficiently inspected, etc. Additionally, if the transparent or translucent panels 1, 11 are damaged, for example, during the repair of the bridge deck 3, the transparent or translucent panels 1, 11 may be repaired or replaced. For example, the transparent or translucent panel 1 between two adjacent bridge beams 2 may be repaired or replaced. In another aspect, one or more portions (e.g., sections, layers, etc.) of the transparent or translucent panel 1 may be replaced when damaged, worn down, or otherwise in need of replacement. For example, referring to FIG. 2, if the portion 6 of the transparent or translucent panel 1, for example, one or more transparent or translucent sheets, is damaged, worn down, etc., then the portion 6 may be removed and either repaired or replaced with a new portion 6. Replacement of the portion 6 may include replacing one or more transparent or translucent sheets, or may include replacing the portion 6 over an entire section of the transparent or translucent panel 1. In this example, the supports or reinforcements 5 and other components of the mounting system 10 may be left in place. Alternatively or additionally, one or more of the supports or reinforcements 5 and/or other components of the mounting system 10 may be removed, repaired, replaced, etc. For example, one or more of the supports or reinforcements 5, angles 4, anchors 4A, etc. may be removed, repaired, replaced, etc. Similarly, referring to FIG. 3, one or more portions of the transparent or translucent panel 11 and/or mounting system 20 may be removed, repaired, replaced, etc. In one aspect, again referring to FIG. 3, one or more portions of the transparent or translucent panel 11 and/or mounting system 20 may be temporarily removed, for example, to allow access to a bottom portion of the bridge deck 3. In this aspect, the inspector may more closely inspect the bridge deck 3, may repair the bridge deck 3, etc.

Accordingly, the transparent or translucent panels 1, 11 and the mounting systems 10, 20 discussed herein form a modular system that may be used multiple times, for example, allowing for reuse of materials, reducing waste, reducing overall costs, etc. The transparent or translucent panels 1, 11 and the mounting systems 10, 20 discussed herein may be manufactured and/or supplied as a kit, as many components (e.g., angle 4) may be standard components to support the transparent or translucent panels 1, 11. Furthermore, the size and/or shape of the transparent or translucent panels 1, 11 may be easily modified or adjusted for particular bridge, for example, based on particular spacings between the bridge beams 2, a desired panel thickness, etc. Additionally, the transparent or translucent panels 1, 11 may be resistant to corrosion. The transparent or translucent panels 1, 11 may be able to withstand various types of weather and/or otherwise withstand exposure to the elements. For example, the transparent or translucent panels 1, 11 may be more resistive to corrosion than lumber, for example, as the transparent or translucent panels 1, 11 do not absorb water, do not rot, etc.

Accordingly, the transparent or translucent panels 1, 11 and the support systems 10, 20 detailed above may be manufactured at reduced costs compared to other support systems. For example, the transparent or translucent panels 1, 11 and the support systems 10, 20 detailed above may be manufactured using a simple, repeatable, and modular process. The support systems 10, 20 may be modular to help in reducing the material cost over time, which may make it simple for contractors, or other suitable professionals, to install.

While principles of the present disclosure are described herein with reference to illustrative aspects for particular applications, it should be understood that the disclosure is not limited thereto. Those having ordinary skill in the art and access to the teachings provided herein will recognize additional modifications, applications, examples, and substitution of equivalents all fall within the scope of the aspects described herein. Accordingly, the present disclosure is not to be considered as limited by the foregoing description.

What is claimed is:

1. A transparent or translucent panel system, comprising: one or more transparent or translucent panels, wherein each of the one or more transparent or translucent panels is formed of one or more of glass polymer composites, polycarbonate, fiber reinforced polymer, fiberglass, and poly (methyl methacrylate);

a plurality of angles, wherein each angle is configured to couple the one or more transparent or translucent panels to an upper flange or a lower flange of i-beam bridge beams such that the one or more transparent or translucent panels are spaced away from a bridge deck that is supported by the i-beam bridge beams; and a plurality of anchors, wherein each anchor is configured to couple one of the plurality of anchors to the upper flange or the lower flange of one of the i-beam bridge beams, wherein the transparent or translucent panel system allows for visual inspection of a bridge deck from below the bridge deck, and wherein the one or more transparent or translucent panels contain one or more of a rubber modifier or an ultraviolent light modifier.

2. The transparent or translucent panel system of claim 1, wherein each of the plurality of angles is L-shaped and is formed of a steel.

3. The transparent or translucent panel system of claim 1, wherein the anchors are mechanical or adhesive anchors.

4. The transparent or translucent panel system of claim 1, further comprising:

one or more additional supports configured to be positioned below the transparent or translucent panel, wherein the one or more additional supports includes one or more of joists, bars, tubes, or fabric straps, wherein the one or more transparent or translucent panels are flat or corrugated, and wherein the one or more transparent or translucent panels have a weight of approximately six pounds for per square foot or less.

5. A method of mounting a transparent or translucent panel below an existing bridge deck, wherein the bridge deck is supported by bridge beams below the bridge deck, and wherein each of the bridge beams include a bottom flange and a top flange, the method comprising:

positioning the transparent or translucent panel on respective portions of the bottom flanges of adjacent bridge beams, such that the transparent or translucent panel at least partially overlaps with portions of the bottom flanges, and such that the transparent or translucent panel is spaced away from the bridge deck;

positioning one or more supports or reinforcements below the transparent or translucent panel and above the flanges on adjacent bridge beams, wherein the one or more supports or reinforcements are joists, bars, or tubes formed of steel, and mounting the transparent or translucent panel to the bottom flanges such that the transparent or translucent panel is spaced away from the bridge deck, wherein the mounting of the transparent or translucent panel to the bottom flanges includes coupling the panel to the bottom flanges by a clip connection or only with an adhesive.

6. The method of claim 5, further comprising inspecting an underside of the bridge deck from below and through the transparent or translucent panel for one or more deficiencies, while being protected from material separating from the bridge deck.

7. The method of claim 5, wherein the transparent or translucent panel is formed of one or more of glass polymer composites, polycarbonate, fiber reinforced polymer, fiberglass, and poly (methyl methacrylate).

8. The method of claim 7, wherein the adhesive includes structural VHB tape, and wherein the transparent or translucent panel is coupled to the joists, bars, or tubes via the structural VHB tape.

9. A method of mounting a transparent or translucent panel system below a portion of a bridge deck, the method comprising:

positioning one or more transparent or translucent panels below the portion of the bridge deck;

mounting the one or more transparent or translucent panels to portions of flanges on adjacent bridge beams such that the transparent or translucent panels are spaced away from the bridge deck, wherein mounting the one or more transparent or translucent panels includes attaching an angle to the flanges with one or more anchors;

leaving the one or more transparent or translucent panels in place for a time of for at least four years; and inspecting the portion of the bridge deck from below the one or more transparent or translucent panels for one or more cracks or damaged portions.

10. The method of claim 9, wherein each of the one or more anchors is an adhesive or a mechanical anchor.

11. The method of claim 9, wherein the flanges of respective adjacent bridge beams are bottom flanges such that the one or more transparent or translucent panels are spaced apart from the bridge deck, and wherein edge portions of the one or more transparent or translucent panels at least partially overlaps with each of the bottom flanges.

12. The method of claim 9, wherein the flanges of respective adjacent bridge beams are top flanges, and wherein edge portions of the one or more transparent or translucent panels do not overlap with each of the top flanges.

13. The method of claim 9, wherein the one or more transparent or translucent panels each include a height of approximately 2.5 inches, wherein the one or more transparent or translucent panels each have a weight of approximately 6 pounds per square foot or less, and wherein the one or more transparent or translucent panels are each formed of one or more of a polycarbonate material.

14. The method of claim 9, further comprising: replacing one or more portions of the one or more transparent or translucent panels with a new one or more transparent or translucent panels formed of a polycarbonate material.

15. The method of claim 9, further comprising: temporarily removing one or more portions of the one or more transparent or translucent panels to allow access to a bottom portion of the bridge deck for inspection and/or repair of the bottom portion of the bridge deck.

16. The method of claim 9, wherein mounting one or more transparent or translucent panels includes positioning one or more supports or reinforcements below and spaced apart from the one or more transparent or translucent panels and above the flanges on adjacent bridge beams.

17. The method of claim 16, wherein the one or more transparent or translucent panels are formed of polycarbonate material, wherein the one or more supports or reinforcements are joists, bars, or tubes formed of steel, and wherein the joists, bars, or tubes are coupled to the one or more transparent or translucent panels via structural VHB tape.

18. The method of claim 16, wherein the one or more supports or reinforcements are fabric straps.

19. The method of claim 9, wherein each angle is an L-shaped angle that includes a horizontal portion and a vertical portion, wherein the horizontal portion is approximately two inches in width, wherein the vertical portion is approximately two inches in height, wherein the angle includes a length of approximately eight feet, wherein the horizontal portion supports the one or more transparent or translucent panels, wherein the one or more anchors extend through the vertical portion of the angle, and wherein each anchor is an expansion or epoxy type anchor bolt.

20. The method of claim 19, wherein mounting the one or more transparent or translucent panels to the flanges includes positioning three anchors along the length of each angle.

* * * * *